US006863131B2

(12) United States Patent
Richard

(10) Patent No.: US 6,863,131 B2
(45) Date of Patent: Mar. 8, 2005

(54) EXPANDABLE SCREEN WITH AUXILIARY CONDUIT

(75) Inventor: Bennett M. Richard, Kingwood, TX (US)

(73) Assignee: Baker Hughes Incorporated, Houston, TX (US)

( * ) Notice: Subject to any disclaimer, the term of this patent is extended or adjusted under 35 U.S.C. 154(b) by 64 days.

(21) Appl. No.: 10/202,797

(22) Filed: Jul. 25, 2002

(65) Prior Publication Data

US 2004/0016539 A1 Jan. 29, 2004

(51) Int. Cl.[7] ..... E21B 43/10

(52) U.S. Cl. ..... 166/384; 166/207; 166/227; 166/231

(58) Field of Search ..... 166/206, 207, 166/227, 230–233, 381, 384

(56) References Cited

U.S. PATENT DOCUMENTS

| | | | | |
|---|---|---|---|---|
| 1,518,696 | A | | 12/1924 | Layne |
| 3,431,975 | A | | 3/1969 | Blake |
| 3,678,999 | A | | 7/1972 | Kulikov et al. |
| 3,933,203 | A | | 1/1976 | Evans |
| 4,343,359 | A | | 8/1982 | Krause |
| 4,657,387 | A | | 4/1987 | Heising et al. |
| 4,945,991 | A | | 8/1990 | Jones |
| 5,082,052 | A | | 1/1992 | Jones et al. |
| 5,113,935 | A | | 5/1992 | Jones et al. |
| 5,161,613 | A | | 11/1992 | Jones |
| 5,161,618 | A | | 11/1992 | Jones et al. |
| 5,417,284 | A | | 5/1995 | Jones |
| 5,419,394 | A | | 5/1995 | Jones |
| 5,435,391 | A | | 7/1995 | Jones |
| 5,515,915 | A | | 5/1996 | Jones et al. |
| 5,560,427 | A | | 10/1996 | Jones |
| 5,842,516 | A | | 12/1998 | Jones |
| 5,848,645 | A | | 12/1998 | Jones |
| 5,890,533 | A | | 4/1999 | Jones |
| 6,059,032 | A | | 5/2000 | Jones |
| 6,220,345 | B1 | | 4/2001 | Jones et al. |
| 6,227,303 | B1 | | 5/2001 | Jones |
| 6,263,972 | B1 | | 7/2001 | Richard et al. |
| 6,305,468 | B1 | | 10/2001 | Broome et al. |
| 6,409,219 | B1 | | 6/2002 | Broome et al. |
| 6,412,565 | B1 | * | 7/2002 | Castano-Mears ..... 166/381 |
| 6,457,518 | B1 | * | 10/2002 | Castano-Mears et al. ... 166/207 |
| 2002/0007948 | A1 | | 1/2002 | Bayne et al. |
| 2002/0088744 | A1 | * | 7/2002 | Echols et al. ..... 210/170 |
| 2002/0092649 | A1 | | 7/2002 | Bixenman et al. |
| 2002/0125009 | A1 | | 9/2002 | Wetzel et al. |
| 2003/0056947 | A1 | | 3/2003 | Cameron |
| 2003/0056948 | A1 | | 3/2003 | Cameron |

FOREIGN PATENT DOCUMENTS

| | | | |
|---|---|---|---|
| EP | 1152120 | A2 | 11/2001 |
| GB | 2369382 | A | 5/2002 |
| WO | WO 02/057594 | A1 | 7/2002 |
| WO | WO 03/001027 | A1 | 1/2003 |

* cited by examiner

*Primary Examiner*—Zakiya Walker
(74) *Attorney, Agent, or Firm*—Steve Rosenblatt

(57) ABSTRACT

An expanding screen has an associated spirally wrapped exterior control line. The control line rests in a spiral trough made up in an exterior perforated jacket. The trough can be made by a pair of ridges disposed substantially parallel to each other or by an ordered spacing of raised dimples in the outer perforated jacket to create spiral troughs. At the screen connections centralizers having a spiral path or paths within can serve a dual function of locating the screen prior to expansion and protecting the control line in the joint area. A fiber optic cable can be placed in the control line.

28 Claims, 2 Drawing Sheets

EXPANDABLE SCREEN WITH AUXILIARY CONDUIT

FIELD OF THE INVENTION

The field of this invention is downhole screens that can be expanded in place and, more particularly screens that include a communication conduit to permit monitoring of downhole conditions.

BACKGROUND OF THE INVENTION

Screens have long been used in combination with sand or other proppants to hold open perforations in a formation and to prevent production of particulates from the formation from clogging up the production screens. The common procedure for doing this is known as gravel packing. Eventually, the concept of screen expansion took hold as a possible alternative to gravel packing. In this more recent development, the annular space around the screen was eliminated due to its expansion. The borehole wall would then be in contact with the outermost layer of the screen and the need to deposit sand or other proppants was eliminated in certain applications. Expanding screens are illustrated in U.S. Pat. No. 6,263,972.

Previously, when gravel packing screens, it was known to provide a control line or conduits for a variety of reasons. Conduits running along a screen could be used to move gravel around a sand bridge during deposition of gravel. Such conduits could also carry fiber optics for the purpose of communicating downhole conditions to the surface. This concept is illustrated in U.S. Pat. No. 6,409,219. Methods for fabricating screens have also been developed. For example, U.S. Pat. No. 6,305,468 illustrates joining layers of a non-expanding screen by putting the layers through a die after rolling them together. This technique allowed welds to be eliminated to improve the reliability of the finished product.

The prior designs did not address the issue of how to provide surface communication of downhole conditions when using an expanding screen. There are special conditions to consider when providing a communication conduit in conjunction with an expanding screen. The screen tends to shorten in length as it is expanded. The screen is expanded into a borehole wall. The communication conduit is exposed outside the screen during run in and could get damaged. These issues are all addressed by the present invention. The nature of the solutions will be more apparent to those skilled in the art from a review of the description of the preferred embodiment and the claims, which appear below.

SUMMARY OF THE INVENTION

An expanding screen with an associated spirally wrapped exterior control line is disclosed. The control line rests in a spiral trough made up in an exterior perforated jacket. The trough can be made by a pair of ridges disposed substantially parallel to each other or by an ordered spacing of raised dimples in the outer perforated jacket to create spiral troughs. At the screen connections centralizers having a spiral path or paths within can serve a dual function of locating the screen prior to expansion and protecting the control line in the joint area. A fiber optic cable can be placed in the control line.

DETAILED DESCRIPTION OF THE PREFERRED EMBODIMENT

Figure 1:
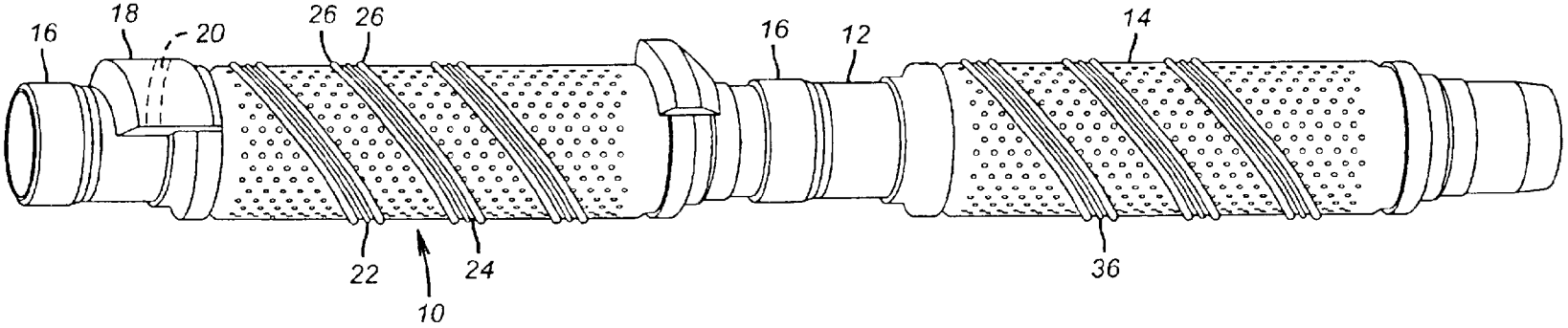
FIG. 1 is an outer view of the screen showing the control line in a spiral trough on the outer jacket.

Referring to FIG. 1, a screen 10 comprises a perforated base pipe 12 with an overlay of a filter media (not shown). Covering the filter media is an outer shroud 14. Screen 10 is made up in joints 16 for ultimate connection to a packer (not shown) in a manner known in the art. At or near the connections 16, there are disposed one or more centralizers 18. Centralizers 18 have one or more generally spirally oriented paths 20 to accept one or more control lines 22. As shown in FIG. 1, the control line 22 is disposed in a spiral trough 24. Preferably, the depth of the trough is as deep or deeper than the diameter of the line 22. A pair of generally parallel ridges 26 whose pitch can be varied to get the desired number of revolutions of the line 22 in any given section of screen 10 between the joints 16 makes the trough. The ridges 26 can be seen in FIG. 2.

In this view, the outer shroud 14 is laid out as a flat sheet. It receives perforations 28 which can be stamped in the sheet as well as the troughs 26. It will be appreciated that edges 30 and 32 are ultimately joined to form a spiral seam as opposed to a seam in line with the longitudinal axis of the cylindrical shape formed. The angle on which sheet 34 is rolled will determine the pitch of the trough 24. The seam between edges 30 and 32 can be welded or sealed in another manner. A fiber optic cable or cables 36 can be run within line 22. It can be routed in mechanically during assembly or pumped in after the sections of screen 10 and associated lines 22 are assembled and run into position in the wellbore.

Figure 2:
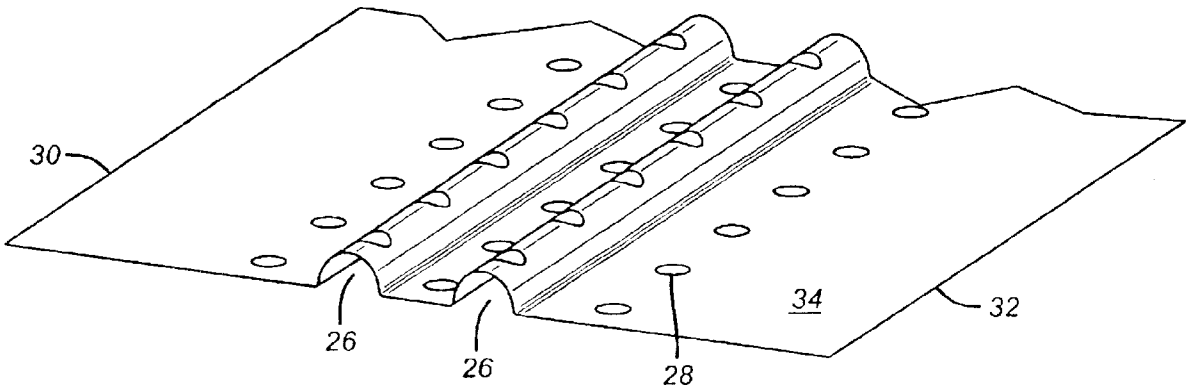
FIG. 2 is an unrolled view of the outer jacket shown in FIG. 1 showing the parallel protrusions that make up the spiral path when the sheet is rolled on an angle and the seams are joined.
Figure 3:
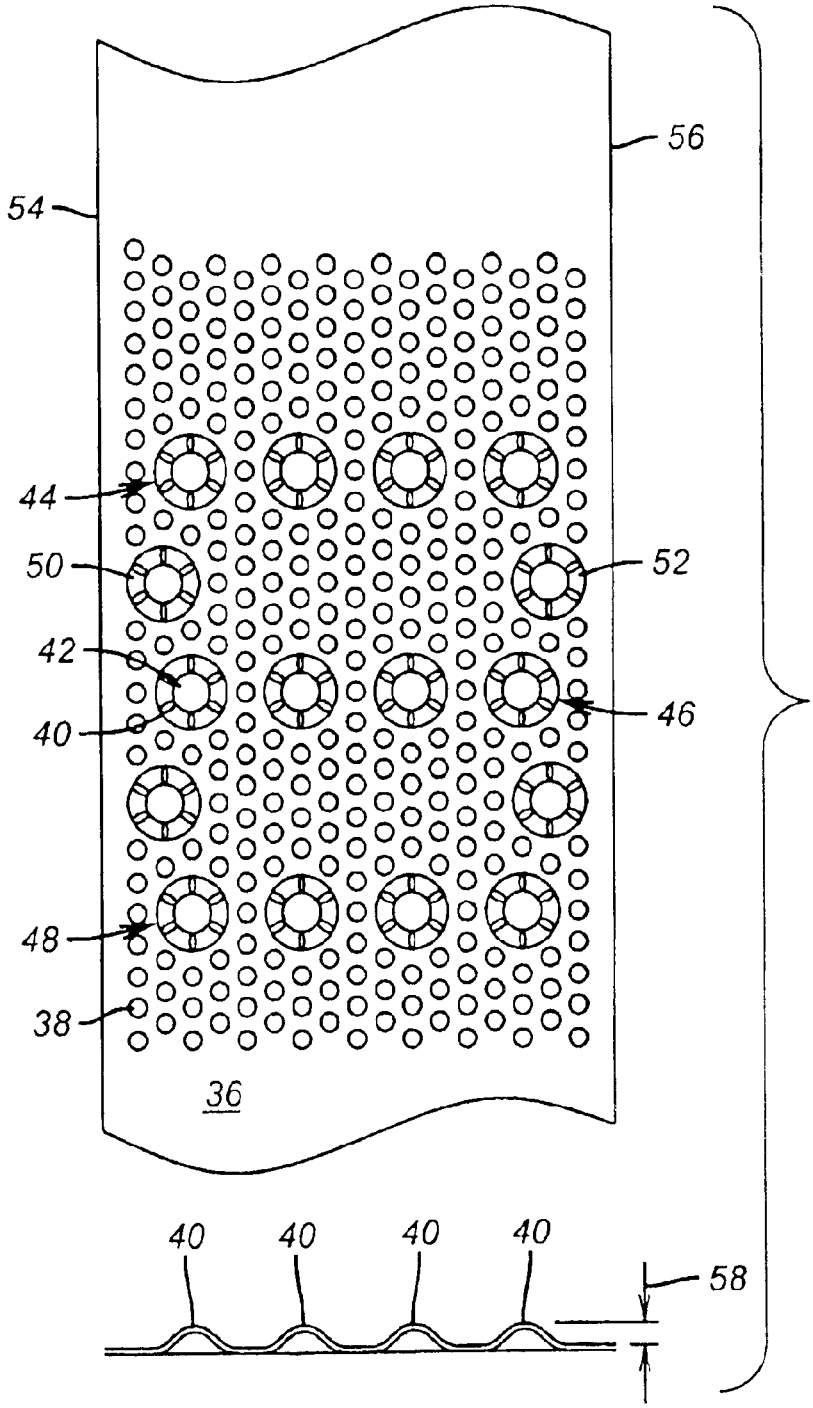
FIG. 3 is an alternate embodiment to FIG. 2 showing an array of dimples that produce a trough when the sheet is rolled at an angle and the seams are joined.

FIG. 3 is an alternate embodiment to FIG. 2. In FIG. 3 a sheet 36 is perforated with small openings 38. Interspersed among the openings 38 are protrusions 40 with preferably each having an opening 42, although they may be closed as well. Protrusions 40 are in preferably parallel rows such as 44, 46, and 48. There are some protrusions between the rows such as 50 and 52. These help to guide the line or lines 22 in the spiral path created when sheet 36 is rolled into a cylindrical shape making a spiral seam of edges 54 and 56, which can be joined by welding or other ways that are equivalent. The height 58 of the protrusions 40 can be varied or uniform. Preferably the height 58 approximates the diameter of the line or lines 22. The pitch of the spiral trough 24 that can also be created with protrusions 40 can be varied depending on the angle that sheet 36 is rolled, akin to the technique for rolling sheet 34.

Those skilled in the art will appreciate that using the troughs 24 will protect the line or lines 22 during run in. During expansion, the spiral winding readily accommodated the longitudinal shrinkage in the overall screen length that occurs. The centralizers 18 allow the spiral path to continue from one filter section to the next. The placement of the line or lines 22 is facilitated by the ready access to the trough 24. After expansion, the jacket openings 38 are not pressed into the borehole wall filter cake because the protrusions 40 act as a standoff. Accordingly, the flow to the filter media below the outer shroud 14 is enhanced after expansion of the screen into the borehole wall.

While the preferred embodiment has been described above, those skilled in the art will appreciate that other mechanisms are contemplated to accomplish the task of this invention, whose scope is delimited by the claims appended below, properly interpreted for their literal and equivalent scope.

I claim:

1. An expanding screen assembly for downhole use, comprising:

a fully circumferential screen comprising an exterior spiral pathway;

at least one conduit in said pathway;

said pathway is at least as deep as the height of said conduit.

2. An expanding screen assembly for downhole use, comprising:

a fully circumferential screen, said screen comprises an outer jacket with a plurality of openings and further comprises an exterior spiral pathway for a conduit on said jacket.

3. The assembly of claim 2, further comprising:

at least one conduit in said pathway and said pathway is at least as deep as the height of said conduit.

4. The assembly of claim 3, further comprising:

at least one fiber optic cable in said conduit.

5. An expanding screen assembly for downhole use, comprising:

a fully circumferential screen comprising an exterior pathway;

said screen comprises an outer jacket with a plurality of openings and said pathway is on said jacket;

said pathway on said jacket comprises a plurality of elongated projections.

6. An expanding screen assembly for downhole use, comprising:

a screen comprising an exterior pathway;

said screen comprises an outer jacket with a plurality of openings and said pathway is on said jacket;

said pathway on said jacket comprises a plurality of elongated projections;

said projections are substantially parallel on said jacket when said jacket is in the form of a flat sheet before it is rolled into a cylindrical shape.

7. The assembly of claim 6, wherein:

the pitch of a spiral path defined by said substantially parallel projections is determined by the angle that said flat sheet is rolled into a cylindrical shape.

8. An expanding screen assembly for downhole use, comprising:

a screen comprising an exterior pathway;

said screen comprises an outer jacket with a plurality of openings and said pathway is on said jacket;

at least one centralizer comprising a path through it that acts as a continuation of said pathway.

9. The assembly of claim 8, wherein:

said screen comprises an assembly of screen sections each having ends with a connection and said at least one centralizer comprises a plurality of centralizers mounted adjacent said ends.

10. An expanding screen assembly for downhole use, comprising:

a fully circumferential screen comprising an exterior pathway;

said screen comprises an outer jacket with a plurality of openings and said pathway is on said jacket;

said pathway on said jacket comprises a plurality of projections.

11. The assembly of clam 10, wherein:

said projections are symmetrical.

12. The assembly of claim 10, further comprising:

at least one conduit in said pathway and said pathway is at least as deep as the height of said conduit.

13. The assembly of claim 12, further comprising:

at least one fiber optic cable in said conduit.

14. An expanding screen assembly for downhole use, comprising:

a screen comprising an exterior pathway;

said screen comprises an outer jacket with a plurality of openings and said pathway is on said jacket;

said pathway on said jacket comprises a plurality of projections;

said projections are symmetrical;

said projections are round.

15. The assembly of claim 14, wherein:

said projections further comprise openings thereon.

16. An expanding screen assembly for downhole use, comprising:

a screen comprising an exterior pathway;

said screen comprises an outer jacket with a plurality of openings and said pathway is on said jacket;

said pathway on said jacket comprises a plurality of projections;

said projections are arranged in rows on said jacket when said jacket is in the form of a flat sheet before it is rolled into a cylindrical shape.

17. The assembly of claim 16, wherein:

said rows are substantially parallel.

18. The assembly of claim 17, wherein:

additional projections are disposed between rows.

19. The assembly of claim 17, wherein:

the pitch of a spiral path defined by said substantially parallel projections is determined by the angle that said flat sheet is rolled into a cylindrical shape.

20. A method of running screen into a wellbore, comprising:

providing a spiral pathway on a fully circumferential screen exterior;

running at least one conduit in said pathway;

making the depth of said pathway at least as large as said conduit;

running in said screen with said conduit in said pathway; and expanding said screen.

21. The method of claim 20, comprising:

extending said pathway in a longitudinal direction.

22. The method of claim 21, comprising:

spirally winding said pathway.

23. The method of claim 20, comprising:

using a fiber optic as said conduit.

24. A method of running screen into a wellbore, comprising:

covering a fully circumferential screen with a jacket providing a spiral pathway on said jacket exterior;

running at least one conduit in said pathway;

making the depth of said pathway at least as large as said conduit;

running in said screen and said jacket with said conduit in said pathway; and expanding said screen and jacket.

25. The method of claim 24, comprising:

using a plurality of projections for said pathway.

26. The method of claim 24, comprising:

connecting to said jacket at least one centralizer comprising a path through it that acts as a continuation of said pathway.

27. A method of running screen into a wellbore, comprising:

covering a screen with a jacket providing a pathway on said jacket exterior;

running at least one conduit in said pathway;

making the death of said pathway at least as large as said conduit;

running in said screen and said jacket with said conduit in said pathway; and expanding said screen and jacket;

using a plurality of projections for said pathway;

arranging said projections in rows on said jacket when said jacket is in the form of a flat sheet before it is rolled into a cylindrical shape.

28. The method of claim 27, comprising:

making said rows substantially parallel.

* * * * *